US006889440B2

(12) United States Patent
Okada

(10) Patent No.: US 6,889,440 B2
(45) Date of Patent: May 10, 2005

(54) COMPASS AND COMPASS-CUTTER WITH RATCHET MECHANISM

(75) Inventor: Shoji Okada, Sakai (JP)

(73) Assignee: Olfa Corporation, Osaka (JP)

( * ) Notice: Subject to any disclaimer, the term of this patent is extended or adjusted under 35 U.S.C. 154(b) by 0 days.

(21) Appl. No.: 10/247,710

(22) Filed: Sep. 20, 2002

(65) Prior Publication Data

US 2003/0056378 A1 Mar. 27, 2003

(30) Foreign Application Priority Data

Sep. 25, 2001 (JP) ..... 2001-291444
Apr. 5, 2002 (JP) ..... 2002-103759
Jun. 27, 2002 (JP) ..... 2002-187806

(51) Int. Cl.[7] ..... B43L 9/04
(52) U.S. Cl. ..... 33/27.031; 33/27.06; 33/18.1
(58) Field of Search ..... 33/26, 27.01, 27.02, 33/27.03, 27.031, 27.032, 27.033, 27.06, 26.06, 18.1–18.2; 434/85, 87, 88, 90–92

(56) References Cited

U.S. PATENT DOCUMENTS 677,339 A * 7/1901 Comstock ..... 33/27.032
800,257 A * 9/1905 Abetz ..... 33/27.031
2,309,809 A * 2/1943 Vane ..... 33/27.032
2,499,673 A * 3/1950 Olejniczak ..... 33/27.031
4,662,073 A * 5/1987 Prusman ..... 33/27.11
4,822,284 A 4/1989 Cohen
4,923,407 A * 5/1990 Rice et al. ..... 439/92
5,233,715 A * 8/1993 Huang ..... 33/485
5,542,185 A * 8/1996 Boda ..... 33/27.02
5,596,809 A * 1/1997 Beard ..... 33/27.031
5,895,183 A * 4/1999 McDaniel et al. ..... 409/179
6,167,628 B1 * 1/2001 Jones et al. ..... 33/27.03
6,276,067 B1 * 8/2001 Hsu ..... 33/30.1
6,546,634 B2 * 4/2003 Ming ..... 33/27.032

FOREIGN PATENT DOCUMENTS

| | | |
|---|---|---|
| DE | 29706392 | 7/1997 |
| FR | 933784 | 9/1946 |
| GB | 1375155 | 11/1974 |
| GB | 2285594 | 7/1995 |

OTHER PUBLICATIONS

European Search Report.
MARTOR catalogue, p. 10.

* cited by examiner

*Primary Examiner*—Diego Gutierrez
*Assistant Examiner*—Yaritza Guadalupe
(74) *Attorney, Agent, or Firm*—Crowell & Moring LLP

(57) ABSTRACT

A manipulator of a compass for drawing a circle or a compass-cutter for cutting an object in circular configuration is provided with a mechanism for transmitting the force from the user's hand only in one direction. With such the construction, a user can smoothly draw a complete circle at 360 degree, or can cut a paper, a cloth and so on in circular configuration, without re-pinching the manipulator during operation, in a manner for a ratchet which is a commercially available tool.

11 Claims, 14 Drawing Sheets

COMPASS AND COMPASS-CUTTER WITH RATCHET MECHANISM

BACKGROUND OF THE INVENTION

1. Field of the Invention

The present invention relates to a compass provided with a ratchet mechanism. In particular, the present invention also relates to, not only a compass for drawing a circle, but also a compass-cutter for cutting a cloth in circular configuration, the compass-cutter being provided with a ratchet mechanism.

2. Description of the Related Art

FIG. 1 shows an ordinary compass 10, which is used for drawing a circle on, for example, a drawing paper. The compass 10 comprises a pair of legs 11, 15 the open angle therebetween can be adjusted, and a manipulate portion 19 which is provided on a location where the legs 11 and 15 are interconnected. The leg 11 is provided with a needle 12 on its distal end, and the other leg 15 carries a pencil 16 on its distal end.

When a user draws a circle, the user pinches the manipulate portion 19 with fingers, and moves the pencil 16 along a circular path, with the needle 12 stuck on a drawing paper being the center of the circular path. During this operation, it may be difficult to draw a complete 360 degree circle in a single action without re-pinching the manipulate portion with the fingers. Therefore, the user often re-pinches the manipulate portion before completing a circle, and thereafter finishes the circle. This action of re-pinch is cumbersome, and if this re-pinch action is poor, the user can not draw a precise circle, because of unintentional shift of the needle 12, for example.

On the other hand, if the user forcibly tries to draw up a complete circle in a single action, an excessive force may shift the needle 12 relative to the drawing paper, and as a result, a precise circle could not be drawn.

The above disadvantages also are applicable to a compass-cutter for cutting an object in circular configuration.

SUMMARY OF THE INVENTION

Therefore, an object of the present invention is to provide a compass and a compass-cutter, which can be smoothly manipulated with simple manipulating actions.

The present invention was completed in order to effectively solve the foregoing problems, and provide a compass and a compass-cutter as described below.

The feature of the present invention lies in that a manipulate portion of a compass comprises a ratchet mechanism. This feature can be applied not only to a compass for drawing a circle, but also to a compass-cutter for cutting an object in circular configuration. Note that an expression "drawing a circle" covers not only the fact to draw a circle with a pencil carried on one leg of a compass, but also the fact to draw a circle with a needle on metal surface.

Generally, the manipulate portion is intended for manipulation with fingers. But, when the compass is large sized, or when the object to be cut is hard, it may be preferable to manipulate the compass with a tool. In such the case, it is preferable that at least a part of the manipulate portion has a configuration adopted to be engaged with a tool.

Further, the manipulate portion comprising the ratchet mechanism can be constituted as a separable component from a body of the compass. In such the case, a commercially available tool (for example, a ratchet handle for socket wrench, and so on) can be used as the manipulate portion comprising the ratchet mechanism.

BRIEF DESCRIPTION OF THE DRAWINGS

This and other objects and features of the present invention will become apparent from the following description taken in conjunction with the preferred embodiments thereof with reference to the accompanying drawings.

DETAILED DESCRIPTION OF THE PREFERRED EMBODIMENTS

Figure 2:
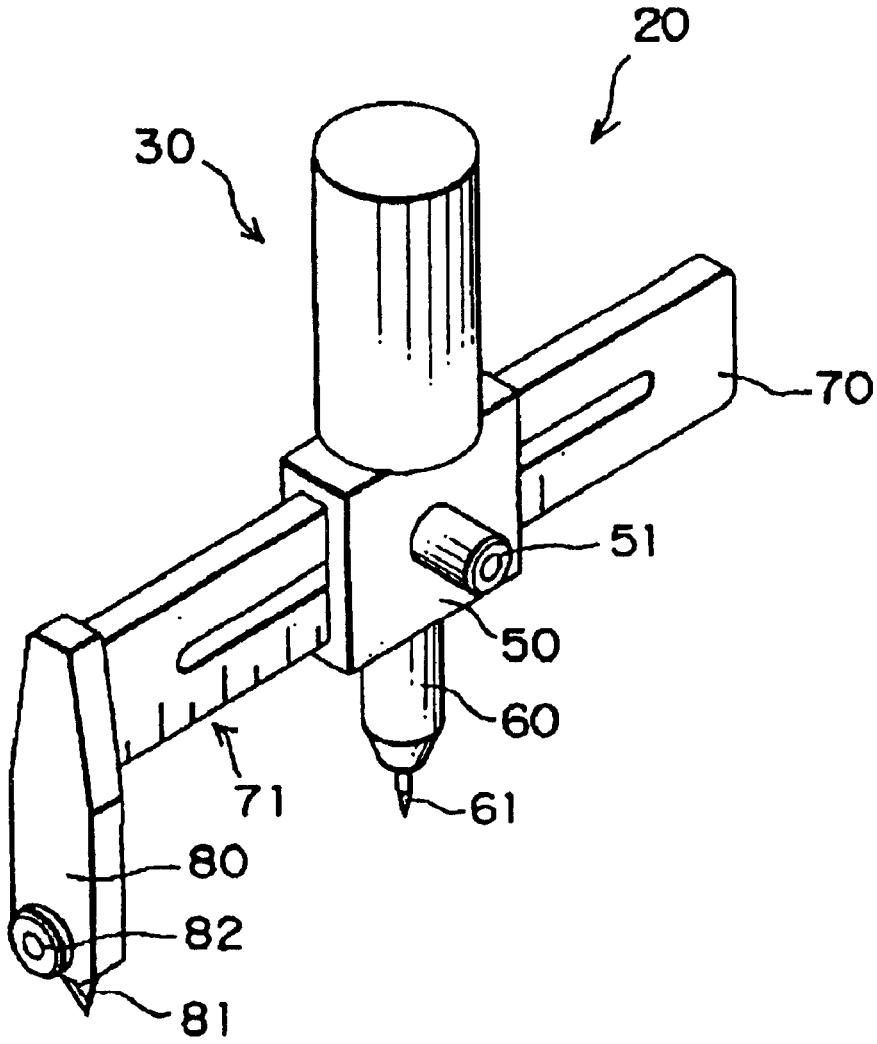
FIG. 2 shows a perspective view of a compass-cutter according to an embodiment of the present invention.
Figure 3:
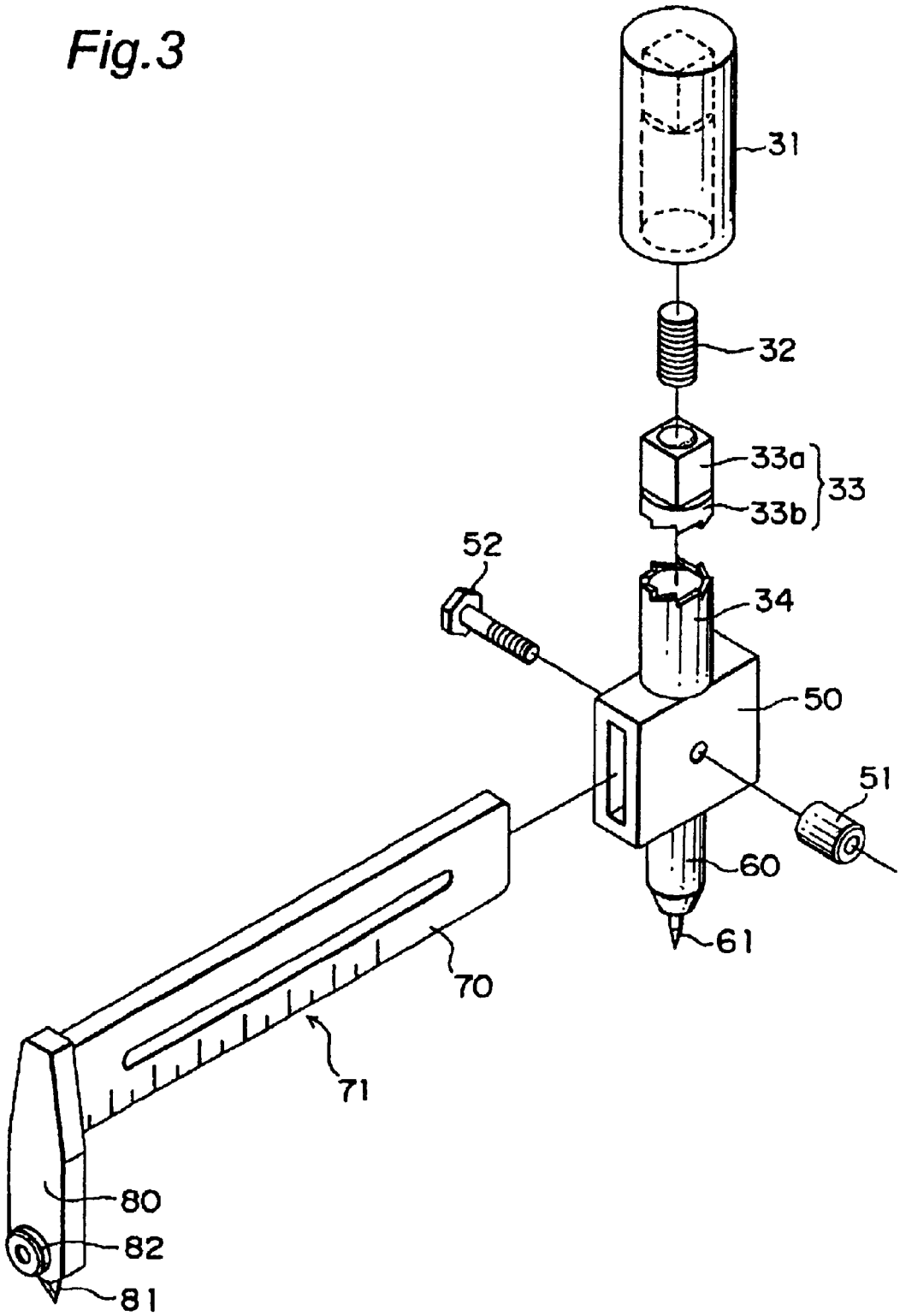
FIG. 3 shows a exploded perspective view of the compass-cutter in FIG. 2.
Figure 4:
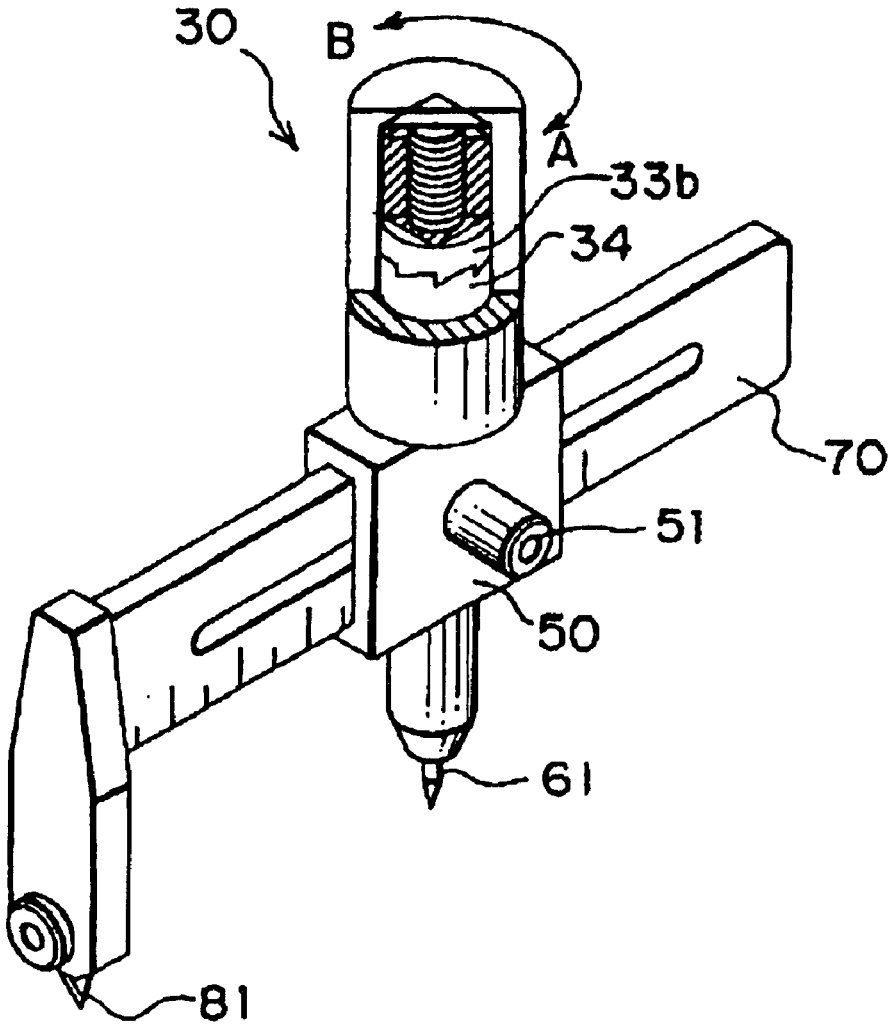
FIG. 4 shows a partially-sectioned perspective view of the compass-cutter in FIG. 2.

The embodiments of the present invention will be described in detail below, with reference to the accompanying drawings. FIGS. 2 to 4 show a compass-cutter 20 according to an embodiment of the present invention. FIG. 2 shows a whole perspective view, FIG. 3 shows an exploded perspective view, and FIG. 4 shows a partially-sectioned perspective view.

The compass-cutter 20 is used for cutting a paper or a cloth in a circular configuration. In use, a user sticks the needle 61 at the center of a circle, and pinches a manipulate portion 30 with fingers and rotates the manipulate portion so as to move a blade 81 along a circular path. The manipulate portion 30 is provided with a ratchet mechanism (one-way clutch) therein.

The ratchet mechanism transmits a rotational driving force only in one direction. As to specific constructions of the ratchet mechanism, a variety of ratchet mechanisms are known, and therefore, in the present invention, the specific construction of the ratchet mechanism is not limited to particular construction. FIGS. 3 and 4 are intended to show an example of the ratchet mechanism.

(Construction of a Ratchet Mechanism)

At the upper side of a compass body 50, the first cylindrical member 34 is fixed, so that the compass body 50 and the first cylindrical member 34 can not be rotated relative to one another. The first cylindrical member 34 is provided with teeth at its upper end.

In FIG. 3, a member 33 located at upper side of the first cylindrical member 34 comprises an upper square column 33*a* and a lower second cylindrical member 33*b*, the column 33*a* and the member 33*b* being integrally formed. The member 33 is inserted in the body 31 of the manipulate portion with a spring 32 located therebetween. In FIG. 4, showing an assembled condition, the member 33 is forced downwardly by spring 32 toward the first cylindrical member 34. In this condition, teeth formed at lower end of the second cylindrical member 33*b* are fully seated against the teeth formed at upper end of the first cylindrical member 34 (refer to FIG. 4).

The member 33 is connected to the body 31 of the manipulate portion, at its square column 33*a*, and therefore, the member 33 must rotate with the body 31 of the manipulate portion. The member 33 can slide axially within the body 31 of the manipulate portion.

Note that, if a relatively heavy member is employed as the member 33, the spring 32 can be omitted. In FIG. 3, force of the spring 32 pushes the member 33 downwardly toward the first cylindrical member 34. But, if the member 33 itself is relatively heavy, the member 33 would be self-engaging with the first cylindrical member 34.

(Function of Ratchet Mechanism)

When the manipulate portion 30 is rotated in the direction of "A" in FIG. 4, both of the teeth formed on the first cylindrical member 34 and on the second cylindrical member 33*b* are engaged, so that the blade also rotates in the same direction. On the other hand, when the manipulate portion 30 is rotated in the direction of "B" in FIG. 4, the teeth of member 33 slide along the upper surface of the teeth of member 34, and therefore no rotation force is passed from the manipulate portion 30 to the blade. Thus, the blade 81 remains stationary.

Therefore, after first pinching the manipulate portion 30 with fingers to rotate the manipulate portion 30 in the direction of "A", so as to cut a paper (or cloth) with the blade 81, when the cutting operation proceeds to some extent, the manipulate portion 30 is rotated in the direction of "B" while the blade 81 remains stationary, and then the manipulate portion 30 is again rotated in the direction of "A", to proceed the cutting. Repeating the above procedures, the user can smoothly rotate the blade a full 360 degrees with simple hand actions, without excessive force or disruptive finger repositioning, as there is no need for re-pinching the manipulate portion 30 during the cutting operation.

(Other Mechanism of the Compass-Cutter 20)

The remarkable construction and function of the compass-cutter 20 according to the present invention are described as above, and the other matters are generally well known. Thus, the summarized explanations are made below.

The blade 81 is mounted at one end of a horizontal bar 70 via a mount plate 80. A screw member 82 is intended for exchanging the blade 81 with another blade. The horizontal bar 70 is carried on the compass body 50 so as to slide in horizontal direction. The interval between the needle 61 and the blade 81 (namely, the radius of circle) can be adjusted with a bolt 52 and screw member 51. The horizontal bar 70 bears a scale 71 for indicating the interval.

The needle 61 is located co-axially with the manipulate portion 30, and is fix to lower side of the compass body 50 via a shaft member 60.

(A Modification of the Manipulate Portion)

Figure 5:
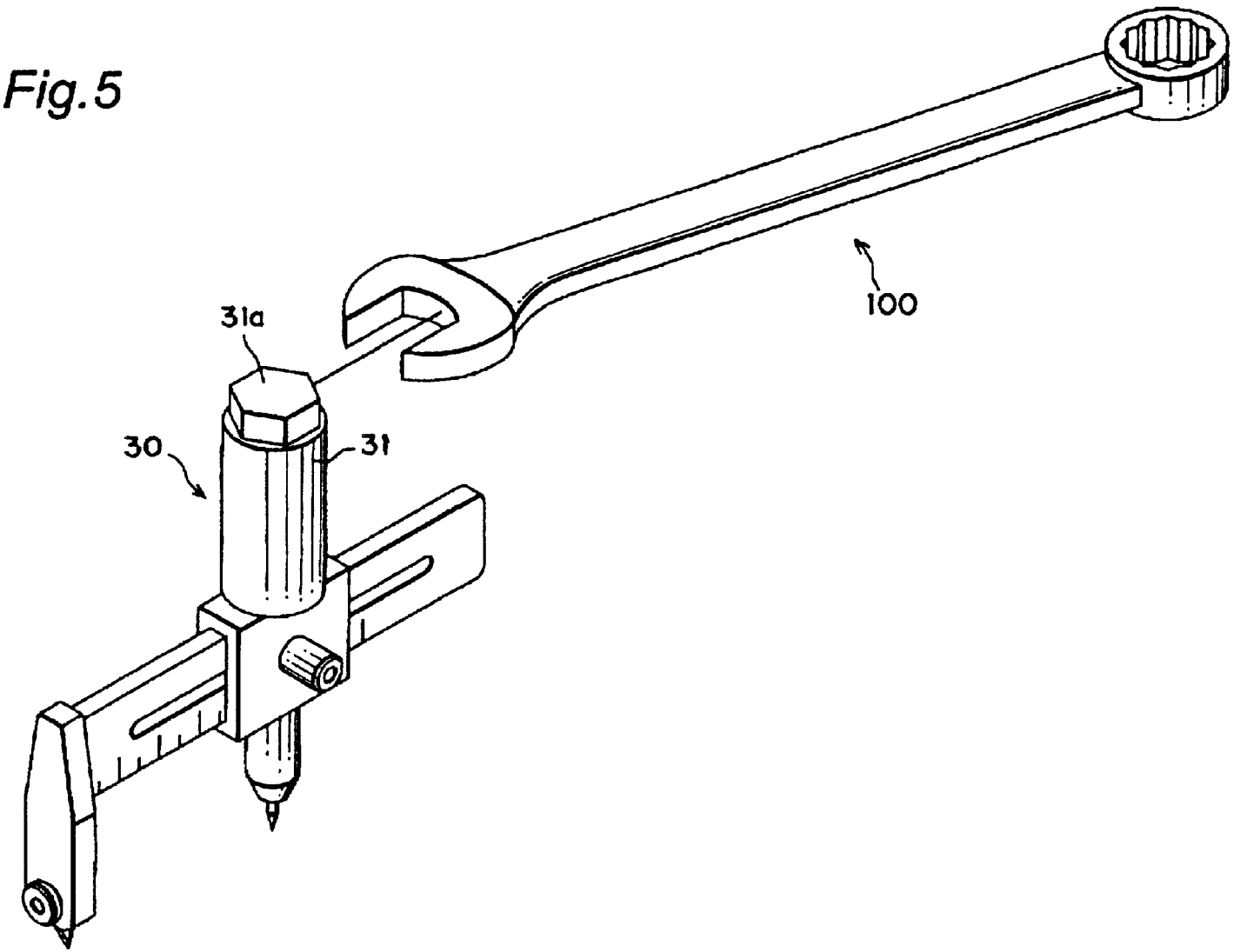
FIG. 5 shows a modification wherein the manipulate portion has a hexagonal head adopted to be engaged with a spanner.

In FIG. 5, there is shown a modification of the compass-cutter 20 described before. In this modification, the head 31*a* of the body 31 of the manipulate portion is formed in hexagonal configuration. As to the other constructions, the modification has the same features as those of the compass-cutter 20, and a ratchet mechanism is enclosed in the manipulate portion 30.

The hexagonal head 31*a* of the body 31 is to be engaged with a spanner 100. That is, the compass-cutter in FIG. 5 is not intended for using with directly pinching the manipulate portion with fingers, but is intended for using with the spanner 100. Such the modification is effective, when the object to be cut is hard, or the radius of circle is large.

In the shown modification, the head 31*a* is made hexagonal so as to be engaged with the spanner 100. The configuration of the head does not need to be hexagonal. Any suitable configurations (for example, rectangular) can be employed as long as the configurations match with a tool to be used (spanner, monkey wrench, wrench, and so on). Further, the configuration can be provided at other location than the head of the body 31. For example, the circumferential wall of the body 31 can be partially cut out, so as to be engaged with a tool.

(An Embodiment Wherein the Compass Body and the Ratchet Mechanism are Separated)

Figure 6:
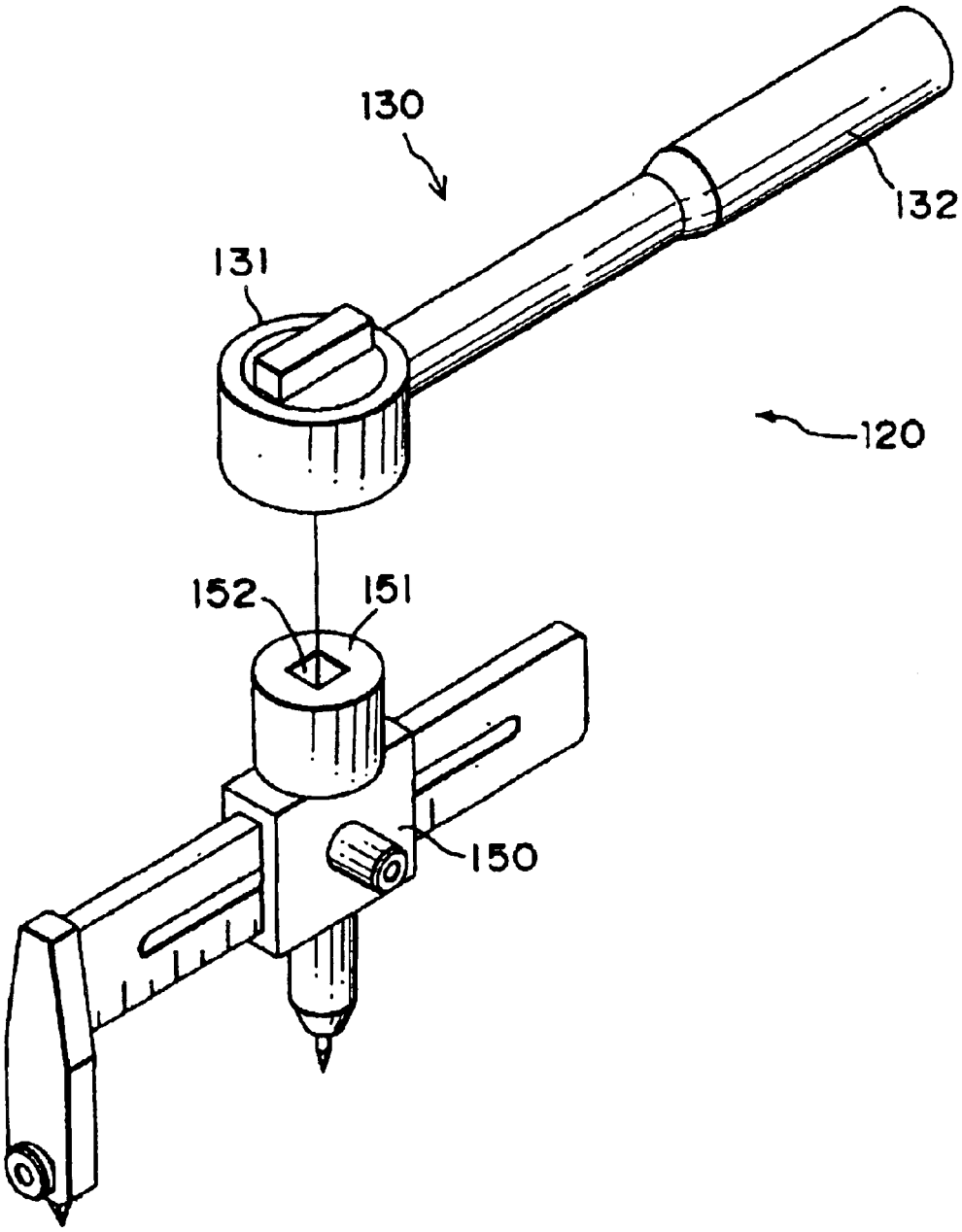
FIG. 6 shows a perspective view of another embodiment wherein the compass body and the ratchet mechanism are separated.

In FIG. 6, there is shown an embodiment wherein the compass body and the ratchet mechanism are separated. This compass-cutter 120 comprises a compass body 150 carrying a blade, and a manipulate portion 130 provided with a ratchet mechanism. The manipulate portion 130 is detachably connected to the compass body 150.

In the compass-cutter 120, the cylindrical member 151 fixed at upper side of the compass body 150 is not provided with a ratchet mechanism, and alternatively, a square recess 152 is formed at the center of the cylindrical member 151. A ratchet mechanism is enclosed in the end portion 131 of the manipulate portion 130. From the end portion 131, a square protrusion extends downwardly to be engaged in the square recess 152, though the protrusion does not appear in FIG. 6. With the protrusion (not shown) being engaged in the square recess 152, a user manipulates the handle 132 to cut an object in circular configuration.

In the compass-cutter 120 shown in FIG. 6, a commercially available tool, such as a ratchet handle for socket wrench, can be employed as the manipulate portion 130, and can advantageously lower the manufacturing cost.

(Other Embodiments)

Figure 7:
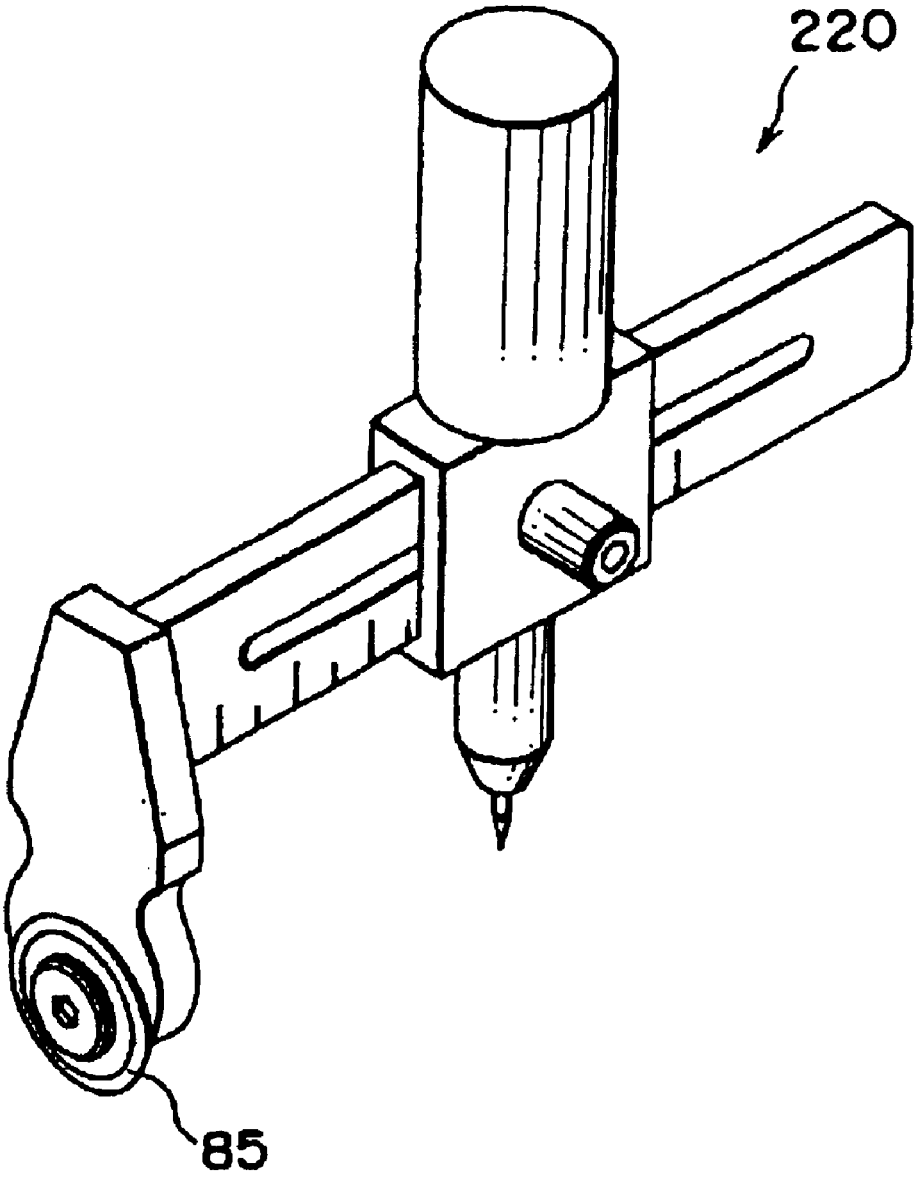
FIG. 7 shows a perspective view of another embodiment wherein a rotary blade is employed.
Figure 8:
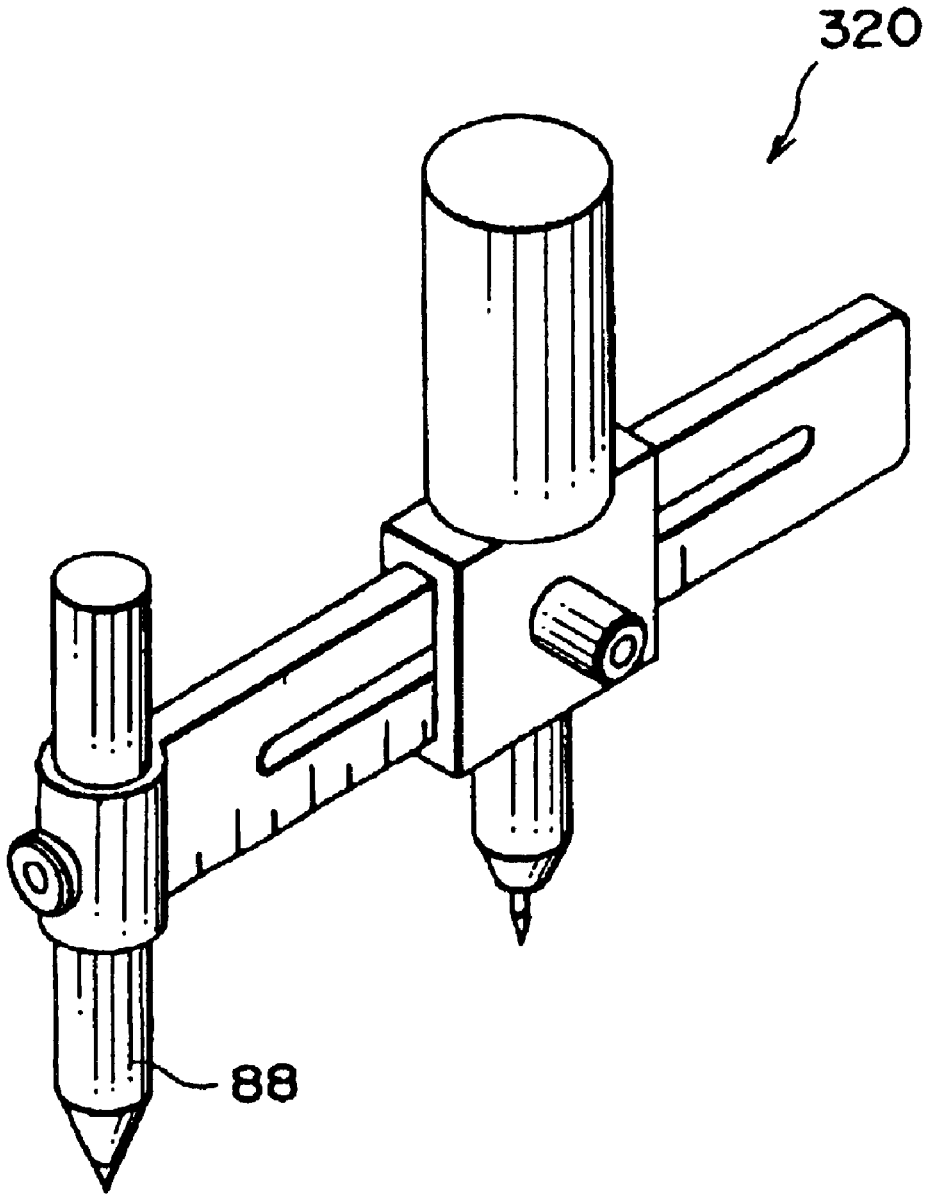
FIG. 8 shows a perspective view of another embodiment wherein the present invention is applied to a compass for drawing a circle.

FIGS. 7 and 8 show other embodiments of the present invention. In the embodiment in FIG. 7, the blade 81 of the compass-cutter 20 in FIG. 2 is substituted with a rotary blade 85. The rotary blade 85 is suitable for thin objects to be cut, such as a cloth. In the embodiment in FIG. 8, a ratchet mechanism is provided to a compass for drawing a circle, and therefore, the blade 81 of the compass-cutter 20 in FIG. 2 is substituted with a pencil 88, which is carried on a horizontal bar. Alternatively, substituting for the blade 81, a needle (not shown) can be carried on the horizontal bar, and then a circle can be drawn on a metal surface.

Both of the compass-cutter 220 in FIG. 7 and the compass 320 in FIG. 8 are provided with a ratchet mechanism like that employed in the compass-cutter 20 in FIG. 2. Therefore, as a modification of the compass-cutter 220 or the compass 320, the configuration of the manipulate portion thereof can be one adopted to be engaged with a tool. Further, the compass body and the separable manipulate portion provided with the ratchet mechanism can be provided, as described above.

(Another Ratchet Mechanism)

Figure 9:
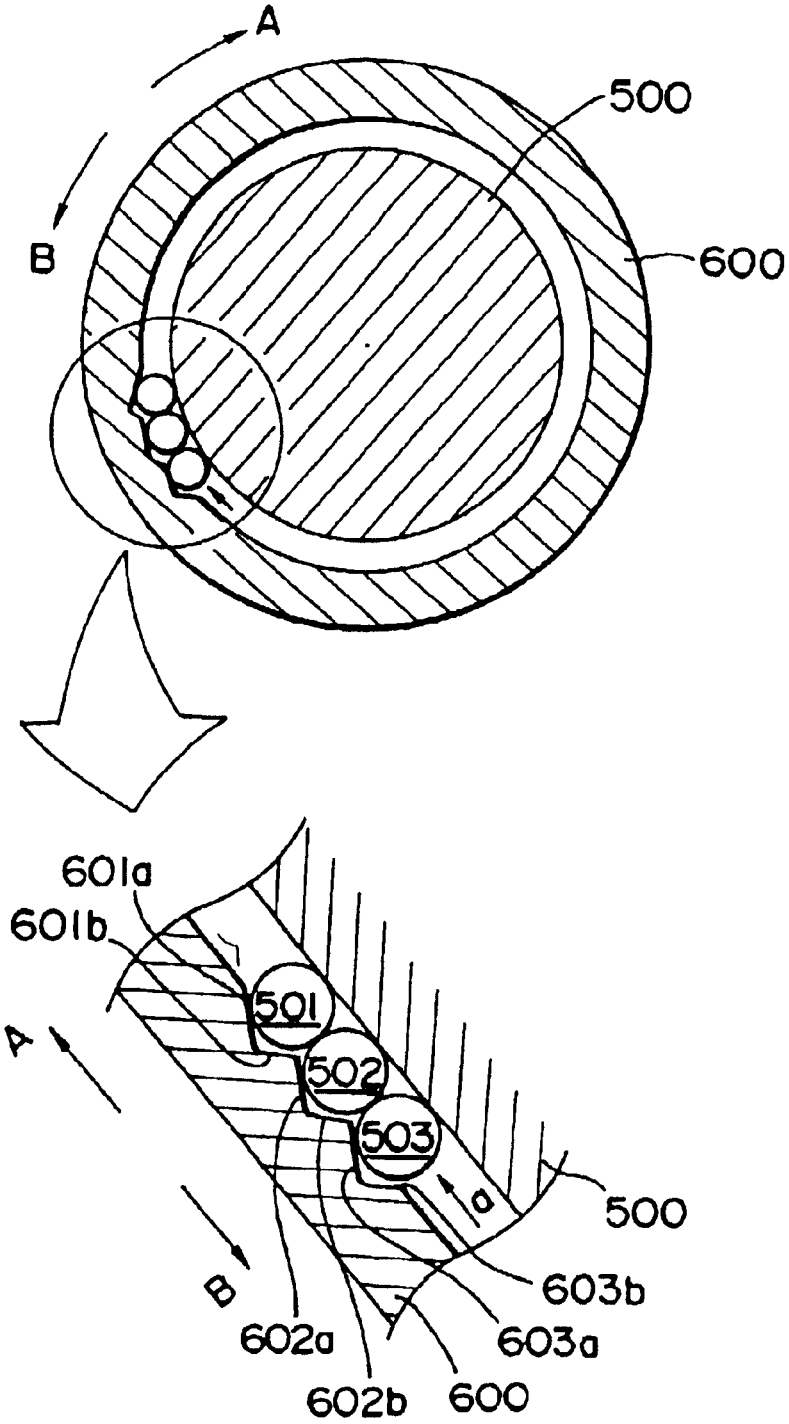
FIG. 9 is a diagrammatic view explaining the principle of another ratchet mechanism which can be employed in the present invention.

Next, with reference to FIG. 9, another example of a ratchet mechanism is explained. As described before, the term "ratchet mechanism" in the present invention refers to a mechanism which transmits a rotational driving force only in one direction, and the specific construction of the ratchet mechanism is not limited to a particular mechanism disclosed herein. The mechanism shown in FIG. 9 is a so-called one-way clutch which transmits a rotational driving force only in one direction. Note that, the construction of this one-way clutch itself is also known.

FIG. 9 is a cross sectional view explaining the mechanism of the one-way clutch diagrammatically. A center shaft 500 and an outer sheath 600 are arranged co-axially. The outer sheath 600 corresponds to the body 31 of the manipulate portion in FIG. 3, and the center shaft 500 is fixed to the compass body 50 (refer to FIG. 3). When the outer sheath 600 (body of manipulate portion) is rotated in the direction of "B" in FIG. 9, the rotating driving force is transmitted to the center shaft 500 so as to rotate the compass. On the other hand, when the outer sheath 600 (body of manipulate portion) is rotated in the direction of "A" in FIG. 9, the rotating driving force is not transmitted to the center shaft 500, and thus the outer sheath 600 rotates without transmitting rotary motion to the center shaft 500. That is, the compass does remains stationary. The principle thereof is as follows.

The outer sheath 600 carries a plurality of circular columns on its inner surface by means of a holding mechanism (not shown). Although only three columns 501, 502, and 503 are shown in FIG. 9, a plurality of circular columns are arranged along the whole inner surface of the outer sheath 600. Each of the circular columns is held in the gap between the center shaft 500 and the outer sheath 600, with its longitudinal axis being parallel to the axes of the center shaft 500 and the outer sheath 600.

As partially enlarged in FIG. 9, on the inner surface of the outer sheath 600, there are formed many recesses, each of which receives an individual circular column. Each of the recesses comprises a gentle first slope 601*a*, 602*a*, 603*a* and a steep second slope 601*b*, 602*b*, 603*b*. Each of the circular columns 501, 502, 503 is biased in the direction "A" by a spring (not shown and held at the outer sheath 600).

When the outer sheath 600 is rotated in the same direction (the arrow "A") as the direction to which the biasing force of the spring is applied, the rotational torque applied to the outer sheath 600 is not transmitted to the center shaft 500, and therefore, the outer sheath 600 rotates without transmitting rotaty motion to the center shaft 500. Each of the circular columns 501, 502, 503 follows the gentle first slope 601*a*, 602*a*, 603*a* under the biasing force of the spring.

When the outer sheath 600 is rotated in the oppposite direction (the direction denoted by arrow "B"), each of the circular columns 501, 502, 503 is pressed against the gentle first slope 601*a*, 602*a*, 603*a* under the biasing force of the spring. As a result, since the diameter of individual circular column is set larger than the gap between the center shaft 500 and the outer sheath 600, each of the circular columns 501, 502, 503 engages the wedged-space between the gentle first slope and the outer surface of the center shaft 500, so that the rotational torque applied to the outer sheath 600 is transmitted, via the circular columns, to the center shaft 500, and therefore, the compass rotates.

(A Compass-Cutter Wherein the Manipulate Portion can be Always Located at Intermediate Position Between the Rotation Center and the Blade)

Figure 10:
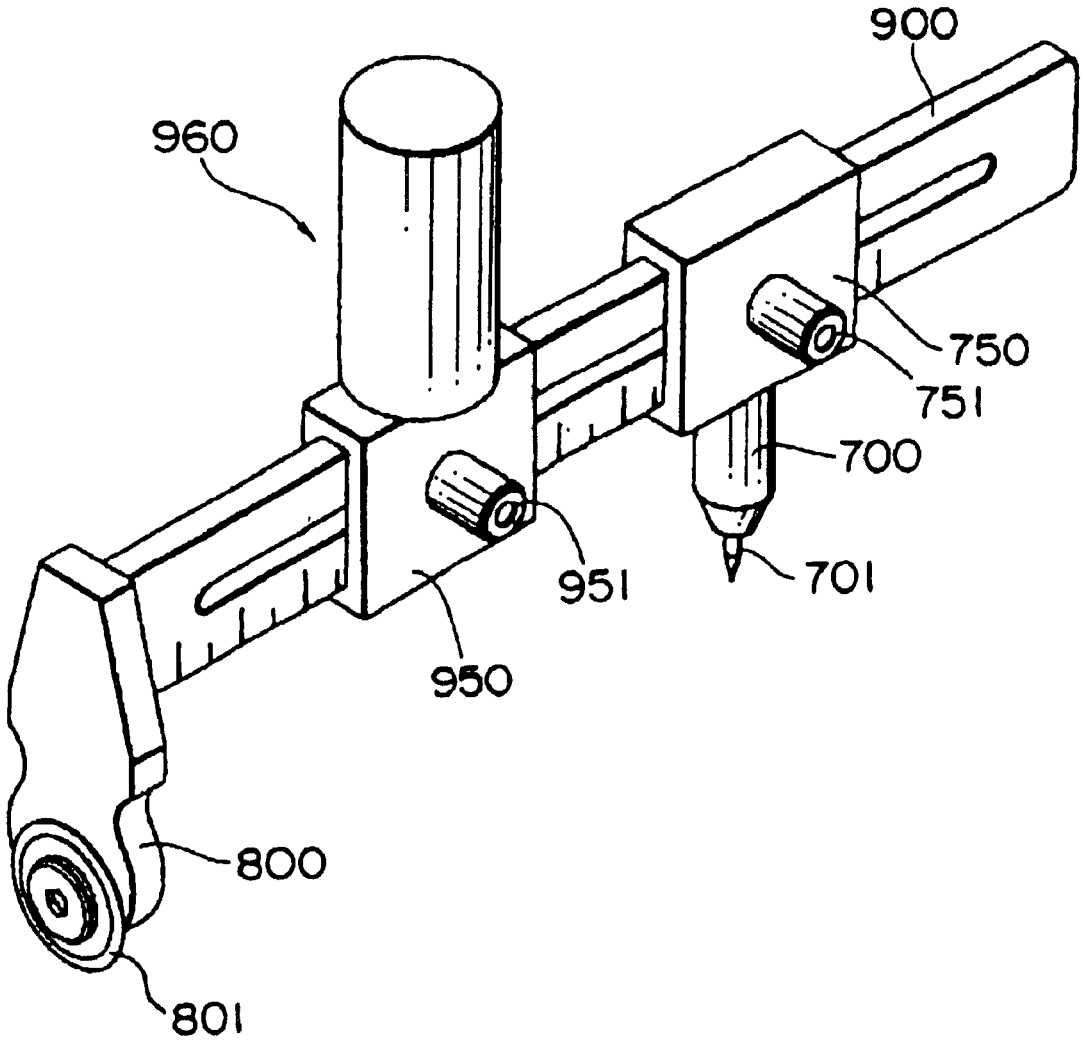
FIG. 10 is a perspective view showing another embodiment of the present invention, wherein the manipulate portion of the compass-cutter can be always located at the intermediate position between the rotation center and the blade.

FIG. 10 shows a compass-cutter according to another embodiment of the present invention. The manipulate portion 960 of this compass-cutter is provided with the same ratchet mechanism as that employed in the compass shown in FIGS. 2 to 4, and is fixed to a compass body 950.

However, in the embodiment in FIG. 10, a needle 701 defining the rotation center of the compass is not fixed to the compass body 950, but is fixed to an distal end of a shaft member (first leg) 700. The shaft member extends downwardly from a slide member 750 which is separated from the compass body 950. By adjusting the screw members 951 and 751, both of the compass body 950 and the slide member 750 can slide along a horizontal bar (lateral bar) 900, and fixed at any position as desired. The mechanism therefore is the same as that employed in the embodiment in FIG. 3.

In the compass-cutter in FIG. 10, when adjusting the locations of the compass body 950 and the slide member 750, the manipulate portion 960 remains always located at an intermediate position between the rotation center (the position of the needle 701) and the blade 801, regardless of the interval length between the rotation center (the position of the needle 701) and the blade 801. Further, by sliding in parallel the slide member 750 along the horizontal bar 900, the rotation radius of the blade 801 fixed to the mount plate (second leg) 800 can be adjusted, and the rotating plane of the blade 801 is always kept in parallel to the center axis of the needle 701.

Such the construction is particularly advantageous in a compass-cutter wherein a blade is utilized for cutting an object in circular configuration. This is explained below.

Figure 1:
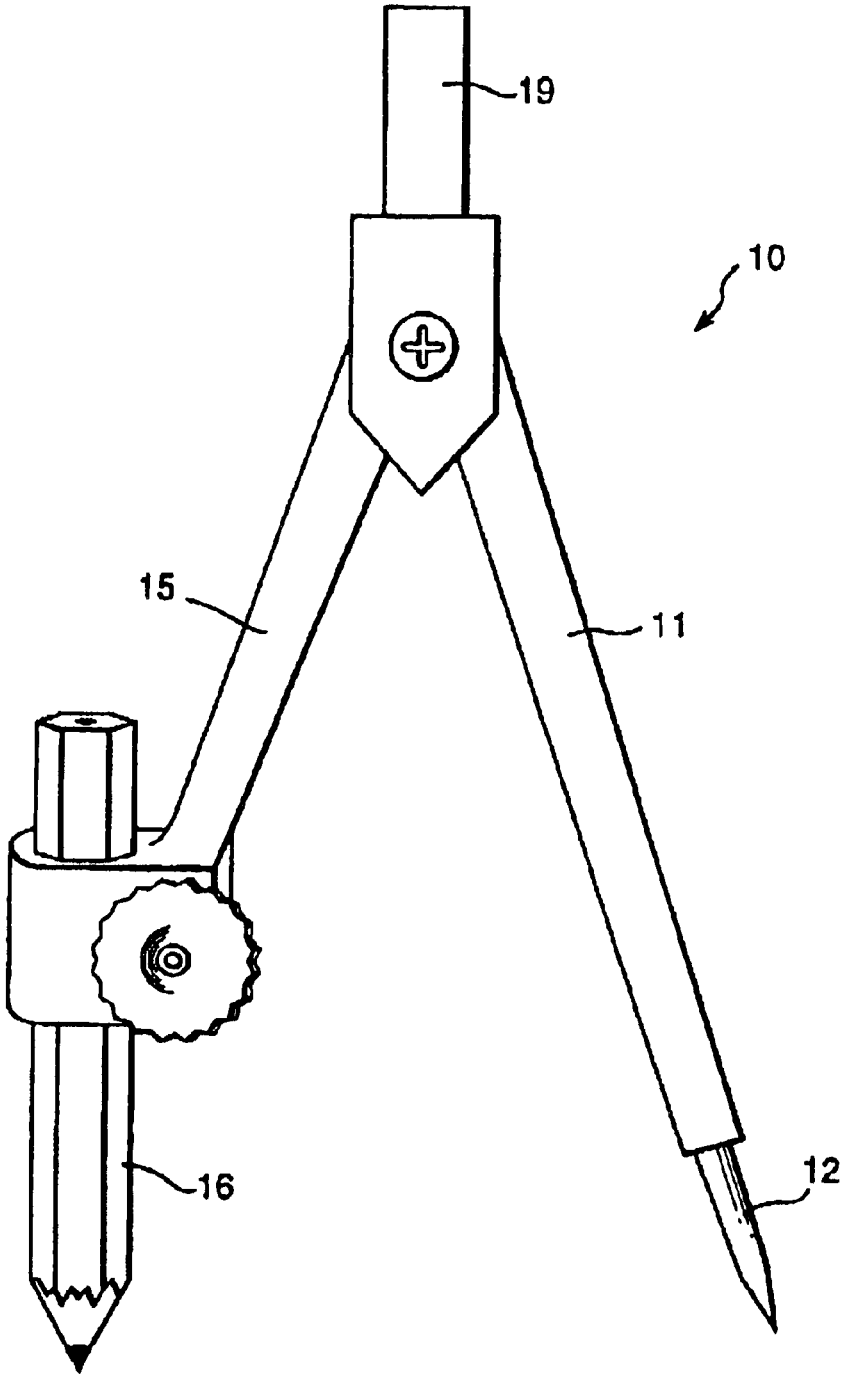
Fig. 1 PRIOR ART
FIG. 1 shows an elevation of a conventional compass for drawing a circle.

When a blade is set to one leg of a compass as shown in FIG. 1, in which the rotation radius is adjusted with an open angle between two legs 11 and 15, the angle between the rotating plane of the blade and the axis of the needle 12 changes as the rotation radius changes. This means that the relative angle of the rotating plane of the blade to the surface of the object to be cut (for example, a cloth) changes, and means that depending on the relative angle value (in other words, depending on the rotation radius), smooth cutting operation just along a desired cutting line may be prevented.

To the contrary, in the construction in FIG. 10 (also in FIGS. 3 and 7), the rotating plane of the blade 801 can be always kept in parallel to the axis of the needle 701, regardless of the interval length between the rotation center (the position of the needle 701) and the blade 801. As a result, the rotating plane of the blade 801 can be always kept in a nearly right angle to the object to be cut, regardless of the rotation radius. Moreover, since the manipulate portion 960 can be always located at intermediate position between the rotation center (the position of the needle 701) and the blade 801, it is possible to deliver the pushing force transmitted from user's hand almost equally to the needle 701 and to the blade 801. This is true when the rotary blade 801 in FIG. 10 is substituted with the stationary blade 81 in FIG. 2.

Using the ratchet mechanisms explained above with the compass-cutter constructed as shown in FIG. 10, cutting operation can be done smoothly with simple manipulating actions. It is to be noted that where the manipulate portion is displaced from the axis of the rotation center, a freely-rotating manipulate portion may be used to achieve the same advantage as that explained with reference to FIG. 10. For example, the manipulate portions as shown in FIGS. 13 and 14 can be employed.

Figure 13:
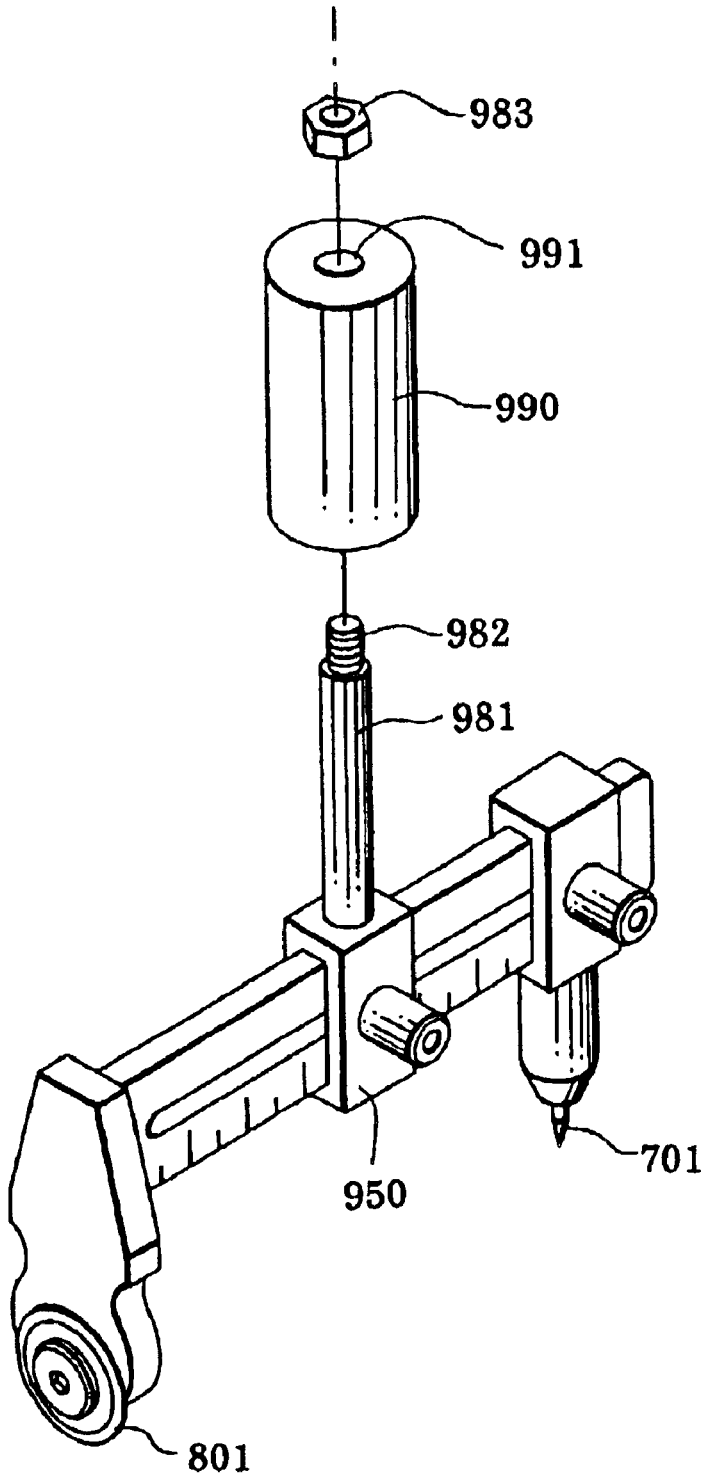
FIG. 13 is a perspective view showing another example of the manipulate portion of the compass-cutter.
Figure 14:
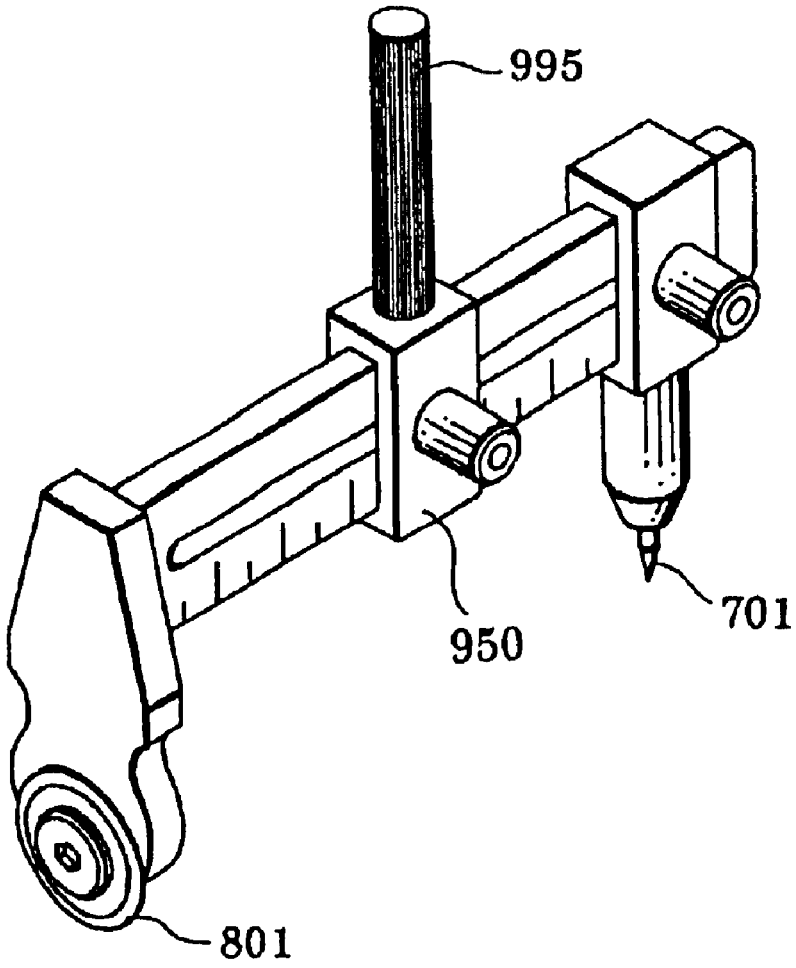
FIG. 14 is a perspective view showing still another example of the manipulate portion of the compass-cutter.

(Manipulate Portion in FIG. 13)

A rod 981 is stationary fixed to the compass-body 950. A threaded end portion 982 of the rod 981 passes through an opening 991 formed on an upper wall of a sheath 990, and a nut 983 is engaged with the threaded end portion 982. As a result, the sheath 990 is attached to the rod 981 so as to freely rotate in both directions.

When such the manipulate portion is employed, the cutting operation with the rotary blade 801 is to be conducted by revolving use's hand holding the sheath 990 around the needle 701. This construction provides additional benefits. For example, the cutting operation can be conducted in both left and right directions, and therefore the cutting operation can be easily conducted regardless of a left-handed user or a right-handed user. Further, the manipulate portion can be simplified as compared to an embodiment employing a ratchet mechanism.

Note that in the case of the manipulate portion in FIG. 13, when the compass body 950 is located at a location near the blade 801, the cutting operation can be performed more easily due to the increased length of the moment arm from the rotation center and the compass body.

(Manipulate Portion in FIG. 14)

The manipulate portion comprises one rod 955, which is stationary fixed to the compass body 950. This construction is inferior to the construction in FIG. 13 in view of the easy operation, but brings a merit that the construction is further simplified.

In the compass-cutters in FIGS. 13 and 14, of course, the rotary blade 801 can be substituted with the blade 81 such as shown in FIG. 2, or with the pencil 88 such as shown in FIG. 8.

(Mechanism for Positioning the Manipulate Portion at Intermediate Position Between the Rotation Center and the Blade)

Figure 11:
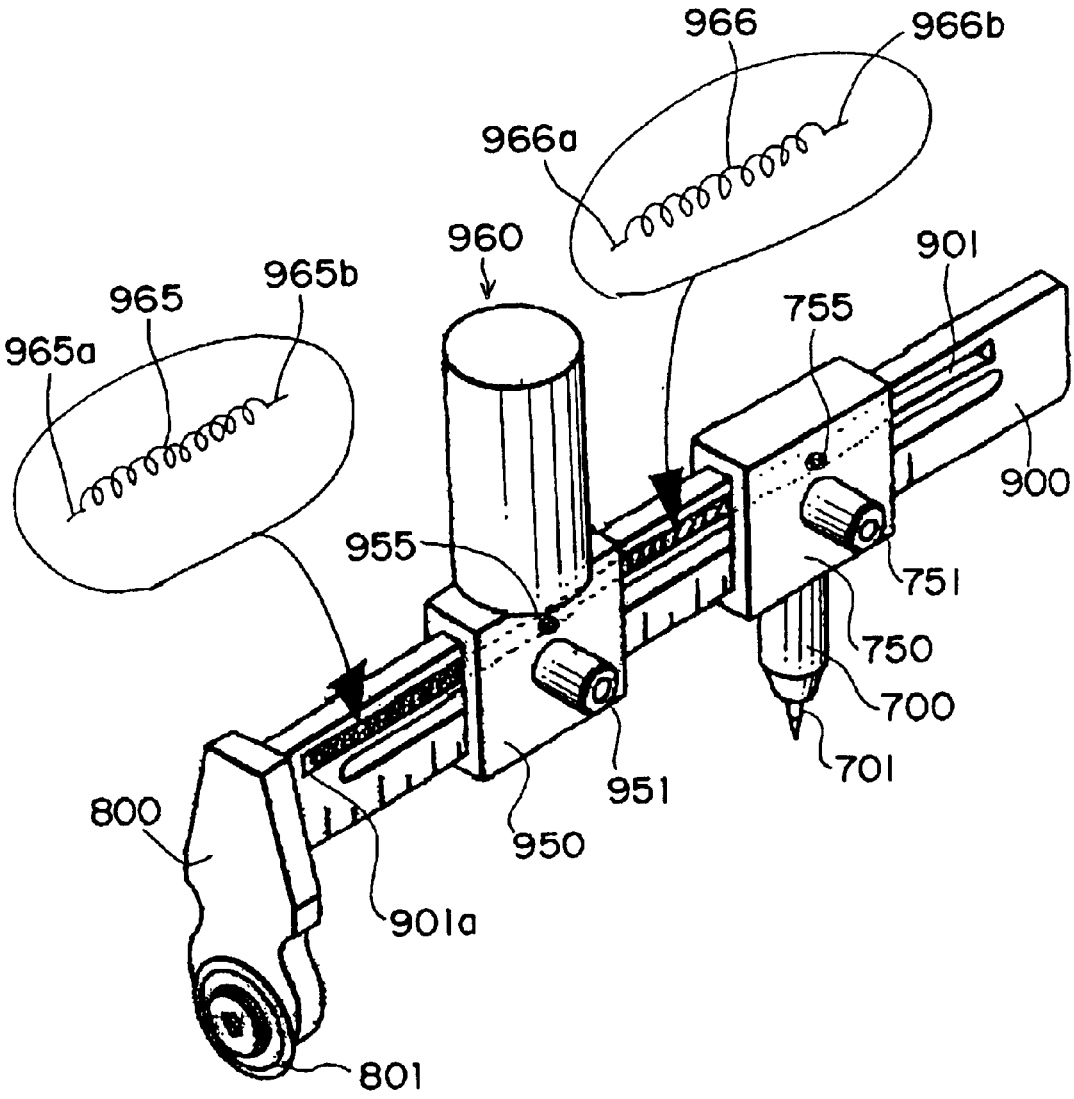
FIG. 11 is an perspective view showing a modification to the compass-cutter to that shown in FIG. 10.

In FIGS. 10 and 11, modifications to the compass-cutter are shown. Both of the modifications are provided with a mechanism, with which a user can easily locate the manipulate portion at an intermediate position between the rotation center and the blade (center-positioning).

In the compass-cutter in FIG. 11, a center-positioning of the manipulate portion 960 can be done with utilizing springs 965 and 966. The springs 965 and 966 are accommodated in an elongated opening 901 which is formed along the longitudinal direction of a horizontal bar 900. One end 965*a* of the spring 965 (second spring) is fixed to the left end 901*a* (in FIG. 11) of the elongated opening, and the other end 965*b* is fixed to a fix pin 955 arranged on the compass body 950. On the other hand, one end 966*a* of the spring 966 (first spring) is fixed to the fix pin 955, and the other end 966*b* is fixed to a fix pin 755 arranged on the slide member 750.

Two springs 965 and 966 have the equal spring-rate. Thus, tightening the screw member 751 to fix the position of the slide member 750, while loosening the screw member 951 to allow the compass body 950 to slide freely, allows the manipulate portion 960 to be automatically located at the intermediate position between the rotation center (the position of the needle 701) and the blade 801, under the opposing forces of the spring 965, 966. Once centered, the screw member 951 may be tightened to fix the position of the compass body 950.

In the embodiment in FIG. 11, the mount plate (first leg) 800 is directly attached to the horizontal bar 900, and one end 965*a* of the spring 965 is connected directly to the horizontal bar itself. Thus, equivalently, the manipulate portion 960 and the mount plate 800 are connected via the spring 965. Note that the mount plate 800 may be made to be able to freely slide relative to the horizontal bar 900, and one end 965*a* of the spring 965 may be attached to such the mount plate 800, like in the embodiment in FIG. 12.

Figure 12:
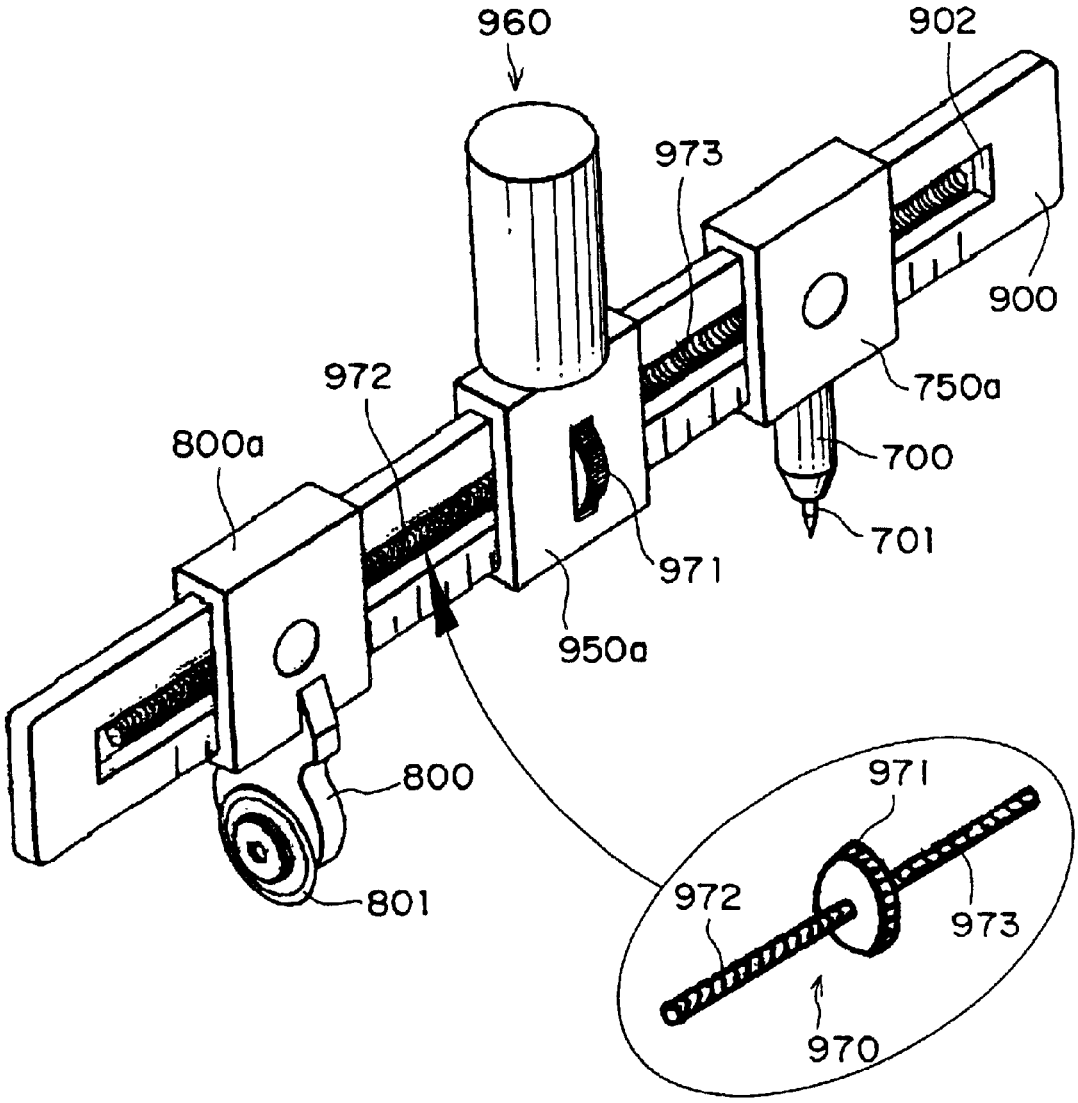
FIG. 12 is an perspective view showing another modification to the compass-cutter to that shown in FIG. 10.

In the compass-cutter in FIG. 12, a screw member 970 is utilized to conduct the center-positioning of the manipulate portion 960. The screw member 970 comprises a center-located dial portion 971, a left screw 972 and a right screw 973, the screws 972 and 973 projecting opposite from the dial portion 971 co-axially. The screw member 970 is located in an elongated opening 902 formed along the longitudinal direction of the horizontal bar 900, and the dial portion 971 is exposed to outward through a slit formed on the compass body 950*a*.

The mount plate 800 carrying the blade 801 is fixed to a slide member 800*a*, and engaged with the left screw 972 via the slide member 800*a*. That is, the slide member 800*a* is provided with a threaded portion (not shown) therein, and this threaded portion is engaged with the left screw 972. On the other hand, the slide member 750*a* carrying the needle 701 is provided with a threaded portion (not shown) therein, and this threaded portion is engaged with the right screw 973.

Since the left screw 972 and the right screw 973 are oppositely threaded, rotating the dial portion 971, exposed on the side wall of the compass body 950*a*, causes the blade 801 and the needle 701 to move toward or away from each other, while the manipulate portion 950 remains at an intermediate position therebetween.

Thus, in the compass-cutters in FIGS. 11 and 12, the manipulate portion 960 easily can be positioned and secured at the intermediate position between the rotation center and the blade.

Although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A compass for drawing a circle, comprising:

a first compass leg with a pointed end or defining a center of a circle;

a second compass leg with a drawing instrument end for carrying a drawing instrument;

a manipulate portion with which a user transmits a rotational driving force to draw the circle; and a ratchet mechanism provided to the manipulate portion which transmits the rotational driving force only in one direction;

wherein the first compass leg and the second compass leg are linked to one another such that a radial distance between the first compass leg point and the second compass leg drawing instrument is adjustable; and wherein the manipulate portion is coupled to the compass legs via the ratchet mechanism, such that when applied with the manipulate portion, the rotational driving force is transmitted to the compass through the ratchet mechanism to cause the second compass leg to rotate about the circle center defined by the first compass leg point.

2. The compass of claim 1, wherein at least a part of the manipulate portion has a configuration adapted to be engaged with a tool.

3. The compass of claim 1, wherein the manipulate portion is constituted so as to be separated from a body of the compass.

4. The compass-cutter of claim 1, wherein:

the point at the pointed end of the first compass leg is a needle, and the drawing instrument carried by the second compass leg is a pencil, wherein when the rotational driving force is applied the pencil is rotated about the needle via a ratchet mechanism to draw the circle.

5. A compass-cutter for cutting an object in circular configuration, comprising:

a first compass-cutter leg with a pointed end for defining a center of a circle;

a second compass-cutter leg with a blade end carrying a blade for cutting the object;

a manipulate portion with which a user transmits a rotational driving force to cut the object in the circular configuration; and a ratchet mechanism provided to the manipulate portion which transmits the rotational driving force only in one direction;

wherein the first compass-cutter leg and the second compass-cutter leg are linked to one another such that a radial distance between the first compass-cutter leg point and the second compass-cutter leg is adjustable; and wherein the manipulate portion is coupled to the compass-cutter legs via the ratchet mechanism, such that when applied with the manipulate portion, the rotational driving force is transmitted to the compass-cutter through the ratchet mechanism to cause the second compass-cutter leg to rotate about the circle center defined by the first compass-cutter leg point.

6. The compass-cutter of claim 5, wherein at least a part of the manipulate portion has a configuration adapted to be engaged with a tool.

7. The compass-cutter of claim 5, wherein the manipulate portion is constituted so as to be separated from a body of the compass-cutter.

8. The compass-cutter of claim 5, wherein the compass-cutter further comprises:

a lateral bar which supports the first leg and the second leg so that an interval length therebetween can be slidably adjusted, wherein the manipulate portion is slidably supported on the lateral bar between the first leg and the second leg, the first leg pointed end carries a needle, and the second leg carries the blade in a plane parallel to a longitudinal axis of the needle.

9. The compass-cutter of claim 8, wherein the manipulate portion and the first leg are connected via a first spring, and the manipulate portion and the second leg are connected via a second spring, and the first spring and the second spring have a substantially equal spring-rate, so that, while the manipulate portion is made freely slidable along the lateral bar, the manipulate portion is urged to an intermediate position between the needle carried on the first leg and the blade carried on the second leg.

10. The compass-cutter of claim 8, wherein the manipulate portion is provided with a screw member comprising a center-located dial portion, a left screw and a right screw, the screws projecting from the dial portion in co-axially opposite directions, the left screw and the right screw are equally leaded in opposite rotation directions, and the first leg and the second leg are engaged with one of the left screw and the right screw, respectively, so that, rotating the dial portion makes the needle carried on the first leg and the blade carried on the second leg separate or approach one another, while the manipulate portion remains at an intermediate position therebetween.

11. The compass-cutter of claim 5, wherein:

the point at the pointed end of the first compass-cutter leg is a needle, and wherein when the rotational driving force is applied the blade is rotated about the needle via a ratchet mechanism to draw the circle.

* * * * *

UNITED STATES PATENT AND TRADEMARK OFFICE

CERTIFICATE OF CORRECTION

PATENT NO. : 6,889,440 B2
DATED : May 10, 2005
INVENTOR(S) : Shoji Okada

It is certified that error appears in the above-identified patent and that said Letters Patent is hereby corrected as shown below:

Column 8,
Line 45, change “of” to -- for --.

Column 9,
Line 4, change “compass-cutter” to -- compass --.

Signed and Sealed this

Twenty-first Day of February, 2006

JON W. DUDAS
*Director of the United States Patent and Trademark Office*